US007073212B1

(12) United States Patent
Moffat

(10) Patent No.: US 7,073,212 B1
(45) Date of Patent: Jul. 11, 2006

(54) TRAINING POTTY WITH DISPOSABLE POTTY LINERS

(76) Inventor: Jennifer Moffat, 381 Caminito Barcelona, Chula Vista, CA (US) 91914

( * ) Notice: Subject to any disclaimer, the term of this patent is extended or adjusted under 35 U.S.C. 154(b) by 0 days.

(21) Appl. No.: 11/056,917

(22) Filed: Feb. 11, 2005

(51) Int. Cl.
*A47K 11/06* (2006.01)

(52) U.S. Cl. ..... 4/484; 4/483; 4/476; 4/902; 4/452

(58) Field of Classification Search ..... 4/484, 4/483, 476, 902, 449, 452, 239, DIG. 5
See application file for complete search history.

(56) References Cited

U.S. PATENT DOCUMENTS

| | | | | |
|---|---|---|---|---|
| 4,162,490 | A * | 7/1979 | Fu et al. | 4/902 |
| 4,221,431 | A * | 9/1980 | Rose | 4/661 |
| 4,882,794 | A | 11/1989 | Stewart, III | 4/451 |
| 5,452,877 | A * | 9/1995 | Riffle et al. | 248/511 |
| D381,070 | S * | 7/1997 | Deniakis et al. | D23/299 |
| 5,690,624 | A | 11/1997 | Sasaki | 604/361 |
| 5,903,932 | A * | 5/1999 | Whitesel | 4/484 |
| 6,038,711 | A * | 3/2000 | Clarke | 4/902 |
| 6,112,339 | A * | 9/2000 | Nichols et al. | 4/484 |
| 6,115,855 | A | 9/2000 | Lorenzo | 4/484 |
| 6,347,415 | B1 * | 2/2002 | Hogue | 4/234 |

FOREIGN PATENT DOCUMENTS

| | | | |
|---|---|---|---|
| GB | 2229699 | A * | 10/1990 |
| GB | 2248180 | A * | 4/1992 |

* cited by examiner

*Primary Examiner*—Khoa D. Huynh
(74) *Attorney, Agent, or Firm*—Goldstein Law Offices P.C.

(57) ABSTRACT

A training potty for toilet training a child having a base that sits on a ground surface having a cutout seat and a cavity. A substantially circular bowl is housed within the cavity of the base and easily removable from the base. The bowl has an outwardly extending lip and a top rim. An insertable disposable liner has an opening and an elastic band around the opening for holding the disposable liner circumventially around the top rim of the bowl until such time that the training potty has been used. The liner has a drawstring closure and a hook and loop fastener for easily removing and disposing of the liner. An interior surface of the liner has a specially designed moisture sensor panel for changing colors and patterns upon contact with liquid or solid waste.

2 Claims, 2 Drawing Sheets

TRAINING POTTY WITH DISPOSABLE POTTY LINERS

BACKGROUND OF THE INVENTION

The invention relates to a training potty, and more particularly, to a training potty having an insertable disposable potty liner used for toilet training infants held in place by an elastic band located around the opening of the liner and placed circumventially outside of the potty until such time that the potty has been used.

The anticipated arrival of a new baby is a joyous time for most couples. As the expectant mother's belly swells, an expectant father might help out by transforming his den or office into a newly decorated nursery. As diapers, bottles and other accessories are purchased, birthing clases are attended and books are read, the coming birth is made all the more meaningful with each passing day. Friends, grandparents-to-be and other family members give thoughtful advice to the expectant parents and baby showers are thrown honoring the blessed event. Although the birth or adoption of a baby is a joyous time, nothing can fully prepare parents for the hard work involved once the baby is actually born. While children are an incredible joy, getting through the first few years of a baby's development can be extremely difficult. Fevers and tempers brought on by colic and teething can render parents concerned and frustrated while sleepless nights spent rocking a restless infant can leave them exhausted. However, snuggling a baby close to one's heart comforting them when they cry, or seeing a toddler take their first few steps, makes all the pitfalls of parenting more than worthwhile. Over time, parents adjust to the schedules and needs of their newborns and sleepless nights and chaotic days give way to a more relaxed routine.

While the joys of parenting have never been disputed, there is one task in regards to a child's upbringing which can be quite challenging. Specifically, potty training a child can be a trying time for both the parent and the toddler. Coaching a child in the use of the potty, encouraging them when they have the occasional "accident" and wiping away tears when a child gets frustrated, are but a few of the many occurrences, experienced by parents or caregivers of potty training toddlers. Most parents agree that the first step to potty training involves purchasing a potty seat. Similar in function to a standard toilet, potty seats are scaled appropriately for use by toddlers and typically feature a removable bowl for cleaning and maintenance. Although extremely practical items, emptying a potty chair after the child has used the facilities can be unpleasant at best. Because of the very function of a potty chair, most parents and caregivers find it necessary to completely clean and disinfect the chair between uses, in order to ensure a hygienic environment for the child.

U.S. Pat. No. 6,115,855 to Lorenzo discloses a disposable, biodegradable liner for a potty having an elastic band around the opening and a closure means using hook and loop fasteners. U.S. Pat. No. 4,882,794 to Stewart discloses a disposable waste containing device comprised of a liquid impervious bag with an absorbent element incorporated. U.S. Pat. No. 5,690,624 to Sasaki discloses a disposable diaper having means to display a color indicator when wetted with urine.

While these units may be suitable for the particular purpose employed, or for general use, they would not be as suitable for the purposes of the present invention as disclosed hereafter.

SUMMARY OF THE INVENTION

It is an object of the invention to produce a means for easily toilet training infants. Accordingly, the invention is a training potty for easily toilet training infants.

It is another object of the invention to provide a hygienic means for keeping a potty training toilet clean. Accordingly, the toilet training potty has an insertable disposable potty liner held in place by an elastic band located around an opening of the liner and placed circumventially outside of the potty until such time that the potty has been used.

It is another object of the invention to provide a means for easily removing and disposing of the liner after use.

Accordingly, the opening of the disposable liner includes a drawstring closer for easily removing and disposing of the liner.

It is another object of the invention to encourage potty training by motivating a child using a visual representation. Accordingly, the disposable liner has an interior surface having a specially designed moisture sensor panel designed to change colors or patterns, upon contact with liquid or solid waste for providing a child with a visual example of a job well done.

This invention is a training potty for toilet training a child having a base that sits on a ground surface having a cutout seat and a cavity. A substantially circular bowl is housed within the cavity of the base and easily removable from the base. The bowl has an outwardly extending lip and a top rim. An insertable disposable liner has an opening and an elastic band around the opening for holding the disposable liner circumventially around the top rim of the bowl until such time that the training potty has been used. The liner has a drawstring closure and a hook and loop fastener for easily removing and disposing of the liner. An interior surface of the liner has a specially designed moisture sensor panel for changing colors and patterns upon contact with liquid or solid waste.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
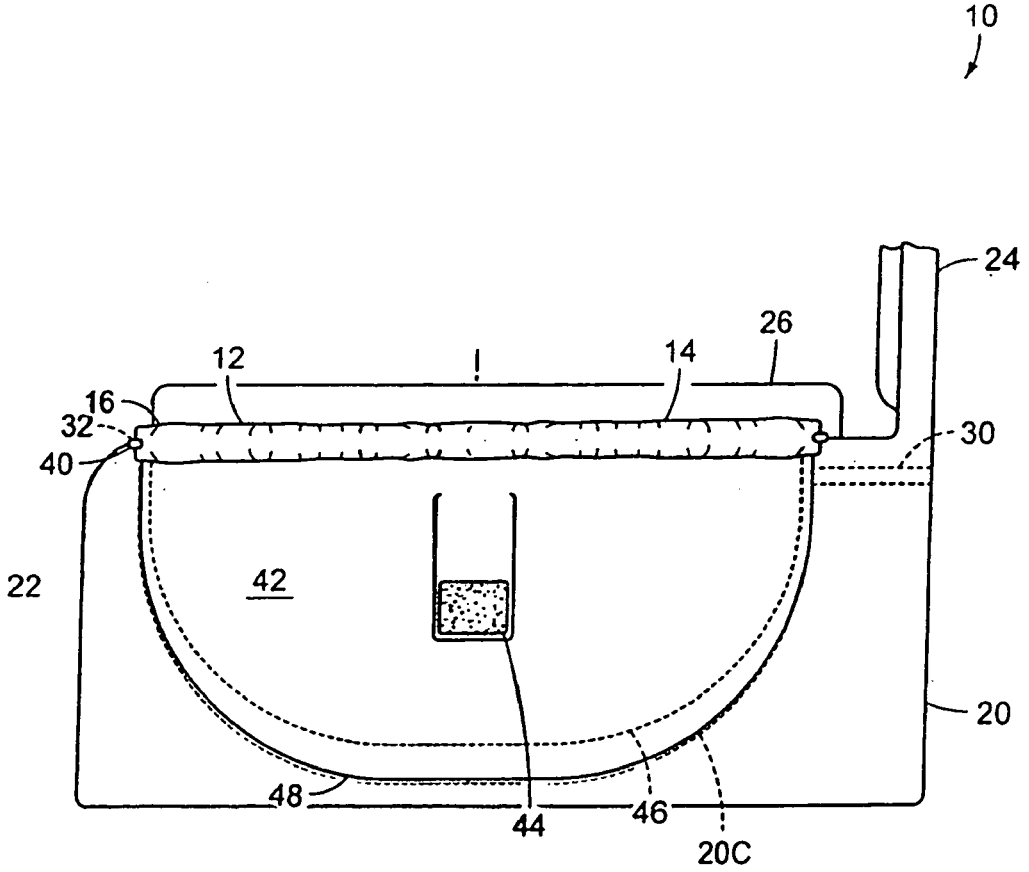
FIG. 1 is a side elevational view of the toilet training potty of the present invention having a cavity therein for holding a bowl having a disposable liner.

FIG. 1 illustrates a training potty 10 for toilet training a child and infants. The training potty 10 has an insertable disposable liner 12 having an opening 14. The training potty 10 with disposable liner 12 is designed to offer a sanitary alternative to traditional methods of cleaning and maintaining the training potty 10.

Figure 2:
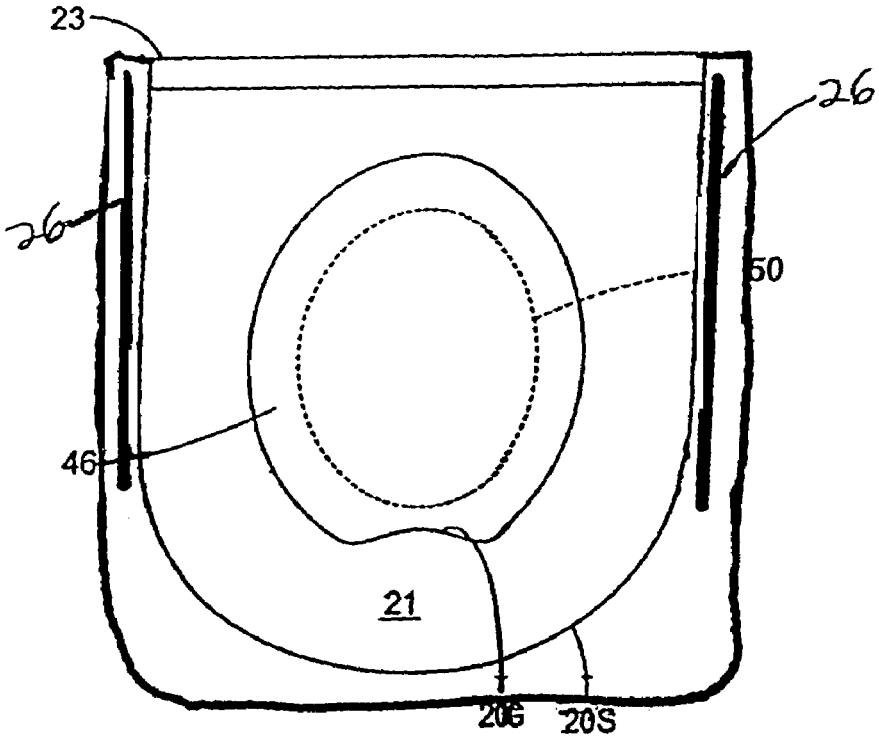
FIG. 2 is a top plan view of the toilet training potty of the present invention, having a cutout seat having a splashguard, and an interior surface of the disposable liner having a moisture sensor panel for changing colors and patterns when wet.

The training potty 10 is similar in function and design to a standard toilet seat, having a substantially rectangular, square or oval shaped base 20 that sits on a ground surface. The base 20 includes a cutout seat 20S, shown in FIG. 2, and a cavity 20C. The cutout seat 20S has a padded surface 21, shown in FIG. 2, for cushioning a child sitting thereon. Within the cavity 20C, the base 20 houses a bowl 22. In addition, the cutout seat 20S includes an upwardly extending splashguard 20G for preventing moisture from escaping the bowl 22 during use. The training potting 10 includes an integrated lid 24 and arm rests 26. The lid 24, shown in FIG. 2, is an oval shaped padded lid, which opens outwardly by a hinged mechanism 23 to expose the bowl 22 therein. When opened, the lid 24 doubles as a cushioned backrest during use. When closed, the lid 24 covers the bowl 22 and may be used as a step.

The bowl 22 is substantially circular in shape and easily removable from the base 20. The bowl 22 has an outwardly extending lip 30, and a top rim 32.

The disposable liner 12 has an elastic band 16 around the opening 14 for holding the disposable liner 12 circumventially around the top rim 32 of the bowl 22 until such time that the training potty 10 has been used. In addition, the opening 14 of the disposable liner includes a drawstring closure 40 for easily removing and disposing of the liner 12. The disposable liner 12 also has an outside front surface 42 having a hook and loop fastener 44 positioned thereon. The hook and loop fastener 44 easily allows the disposable liner 12 to roll up and secure the used disposable liner 12 in a compact coil, similar to rolling a soiled diaper.

The disposable liner 12 also includes an interior surface 46. The interior surface 46 is coated with a layer of absorbent, cotton-like material used in the manufacture of disposable diapers and is backed by an impenetrable plastic outer shell 48. In this manner, liquid waste matter is immediately absorbed and, along with solid waste matter, carefully contained within the disposable liner 12.

To motivate and encourage potty training using the training potty 10, the interior surface 46 has a specially designed moisture sensor panel 50, designed to change colors or patterns, upon contact with liquid or solid waste. Similar in function to a litmus strip or ketone paper, this panel 50 is treated with a safe, nontoxic solution, which, when activated, turns a bright color, thus providing a child with a visual example of a job well done.

Figure 3:
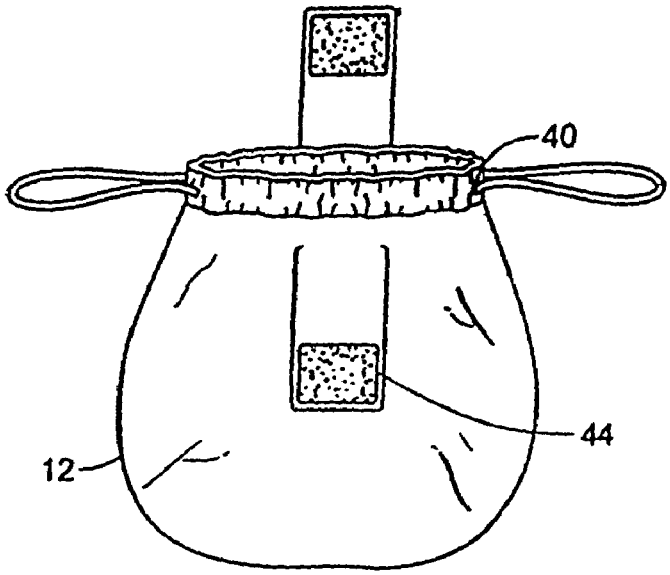
FIG. 3 is a diagrammatic perspective view of the disposable liners of the present invention being easily cinched closed, tied, and securely closed using a hook and loop faster for easy disposal.

In order to toilet train a child using the training potty 10, first, a parent or caregiver within a home, in a designated area, such as a bathroom, positions the training potty 10. Next, the user applies a single disposable liner 12 within the bowl 22 and secures the elastic band 16 around the top rim 32 of the bowl 22, as shown in FIG. 1. Then, the user lifts the lid 24 and the cutout seat 20S to position the bowl 22 within the cavity 20C of the base 20. Then, the cutout seat 20S can be closed downwardly, and the child can use the training toilet 10 as usual. After a child disposes solid or liquid waste therein, the moisture sensor panel 50 changes colors or patterns. Once finished, the parent or caregiver lifts the cutout seat 20S upwardly and removes the bowl 22 therefrom by holding onto the lip 30 of the bowl 22. Then, the elastic band 16 is carefully removed from the top rim 32 of the bowl 22. As shown in FIG. 3, the drawstring closure 40 cinches the disposable liner 12 closed, and is tied securely closed. The disposable liner 12 is folded over, preferably twice, and the hook and loop fastener 44 easily secures the disposable liner closed in a compact coil for easily disposing of. When not in use, the lid 24 can be closed downwardly, and the user can use the training potty 10 as a step.

In conclusion, herein is presented a training potty having an insertable disposable liner used for toilet training infants. The invention is illustrated by example in the drawing figures, and throughout the written description. It should be understood that numerous variations are possible, while adhering to the inventive concept. Such variations are contemplated as being a part of the present invention.

What is claimed is:

1. A training potty for toilet training a child, comprising:

a base that sits on a ground surface having a cutout seat and a cavity, the cutout seat having a padded surface for cushioning a child sitting thereon and an upwardly extending splashguard, the base having an integrated substantially oval shaped padded lid and arm rests extending upwardly beside the cutout seat on the base, said lid opens outwardly by a hinged mechanism, when opened the lid doubles as a cushioned backrest during use, when closed the lid covers the cavity and is used as a step;

a substantially circular bowl housed within the cavity of the base and easily removable from the base, having an outwardly extending lip and a top rim; and an insertable disposable liner having an opening and an elastic band around the opening for holding the disposable liner circumventially around the top rim of the bowl until such time that the training potty has been used, said opening having a drawstring closure for easily removing and disposing of the liner, having an outside front surface having a hook and loop fastener positionable thereon for easily allowing the disposable liner to roll up and secure in a compact coil, having an interior surface coated with a layer of absorbent material backed by an impenetrable plastic outer shell, said interior surface having a specially designed moisture sensor panel for changing colors and patterns upon contact with liquid or solid waste.

2. A method of toilet training a child using a training toilet, having a base having a cutout seat, a lid, and a cavity for housing a bowl, the bowl having a top rim and lip, having disposable liners having elastic bands, moisture sensor panels therein, drawstring closures, and a hook and loop fastener, the steps comprising:

applying the disposable liner within the bowl by securing the elastic band around the top rim of the bowl;

positioning the bowl within the cavity by lifting upwardly the lid and the cutout seat;

closing the cutout seat downwardly, and allowing the child to use the training toilet to discard liquid and solid waste;

changing color or patterns within the disposable liner by applying liquid or solid waste to the moisture sensor panel within the disposable liner; and disposing the disposable liners by lifting the lip of the cutout seat upwardly and removing the bowl from the base and removing the elastic band from the top rim of the bowl and cinching and tying the drawstring closure closed, and folding up the disposible liner and securing the liner in a coil using the hook and loop fastener.

* * * * *